United States Patent [19]

Westin et al.

[11] 4,122,761

[45] Oct. 31, 1978

[54] DANGEROUS GOODS SHIPPING CONTAINER

[75] Inventors: Per-Olov Westin, Ektorp; Per A. Marklund, Skelleftea, both of Sweden

[73] Assignees: AB Svenska Godscentraler, Stockholm; AB Plastkarosser, Skelleftea, both of Sweden

[21] Appl. No.: 795,597

[22] Filed: May 10, 1977

[51] Int. Cl.[2] ..... F24F 13/00; B65J 1/02

[52] U.S. Cl. ..... 98/33 R; 98/52; 220/1.5

[58] Field of Search ..... 98/8–10, 98/32, 33 R, 52–57, 115 SB, 33 A; 220/1.5, 9 B, 15; 62/239, 243

[56] References Cited

U.S. PATENT DOCUMENTS

| | | | |
|---|---|---|---|
| 2,260,999 | 10/1941 | Mann | 98/9 |
| 3,168,030 | 2/1965 | Wilhelmsson et al. | 98/115 SB |
| 3,170,384 | 2/1965 | Krantz et al. | 98/115 SB |
| 3,407,719 | 10/1968 | Temple et al. | 98/32 |
| 3,883,026 | 5/1975 | Selz | 220/1.5 |
| 3,951,336 | 4/1976 | Miller et al. | 98/33 R |
| 4,000,827 | 1/1977 | Emery | 220/1.5 |

FOREIGN PATENT DOCUMENTS

| | | | |
|---|---|---|---|
| 2,206,799 | 8/1972 | Fed. Rep. of Germany | 98/33 R |

*Primary Examiner*—Henry C. Yuen

*Attorney, Agent, or Firm*—Sughrue, Rothwell, Mion, Zinn and Macpeak

[57] ABSTRACT

A gas tight shipping container for transporting dangerous liquids in cans or the like includes a supporting floor grate 17 spaced above a plurality of spilled liquid trays 12, 13 defined on opposite sides of fork lift tyne tunnels 10, 11 to provide a continuous ventillation passage 18 therebetween extending beneath the full area of the floor grate. An exhaust duct 19, 22 extends across one end of the container and draws air through a controlled intake 23 in the opposite end of the container via the passage 18.

8 Claims, 2 Drawing Figures

DANGEROUS GOODS SHIPPING CONTAINER

BACKGROUND OF THE INVENTION

The invention relates to a goods container for transporting dangerous goods, e.g. poisonous liquids, and comprises four side walls, a roof and a supporting bottom with tunnels for lifting tynes.

In the sea transport of dangerous goods containers, e.g. posionous or corrosive liquids, poisonous gases or the like, the ship used for transport must be equipped with so-called weather decks, i.e. decks which are particularly well ventilated and from which gases, for example, cannot leak down into living quarters or the like. When transport partly takes place using ferries on to which trailers are driven, only so-called "car decks" are available, and these do not meet with the requirements for weather decks. This means in practice that if the goods must be transported by road or rail, then large detours may be involved unless vessels with weather decks are available.

SUMMARY OF THE INVENTION

The main object of the present invention is therefore to provide a goods container which can be transported on any type of vessel, or be placed in any type of space without there being the risk of damaged goods, e.g. leaking liquid barrels being able to cause personal injury or poisoning of the surroundings and which further completely eliminates the risk of explosions in the case where damaged goods give off explosive gases.

Briefly, and in accordance with the present invention, a gas tight shipping container for transporting dangerous liquids in cans or the like includes a supporting floor grate spaced above a plurality of spilled liquid trays defined on opposite sides of fork lift tyne tunnels to provide a continuous ventillation passage therebetween extending beneath the full area of the floor grate. An exhaust duct extends across one end of the container and draws air through a controlled intake in the opposite end of the container via the passage.

BRIEF DESCRIPTION OF THE DRAWINGS

An embodiment of the invention will now be described below while referring to the appended drawing, which illustrates the invention in a very simplified way.

DESCRIPTION OF THE PREFERRED EMBODIMENT

Figure 1:
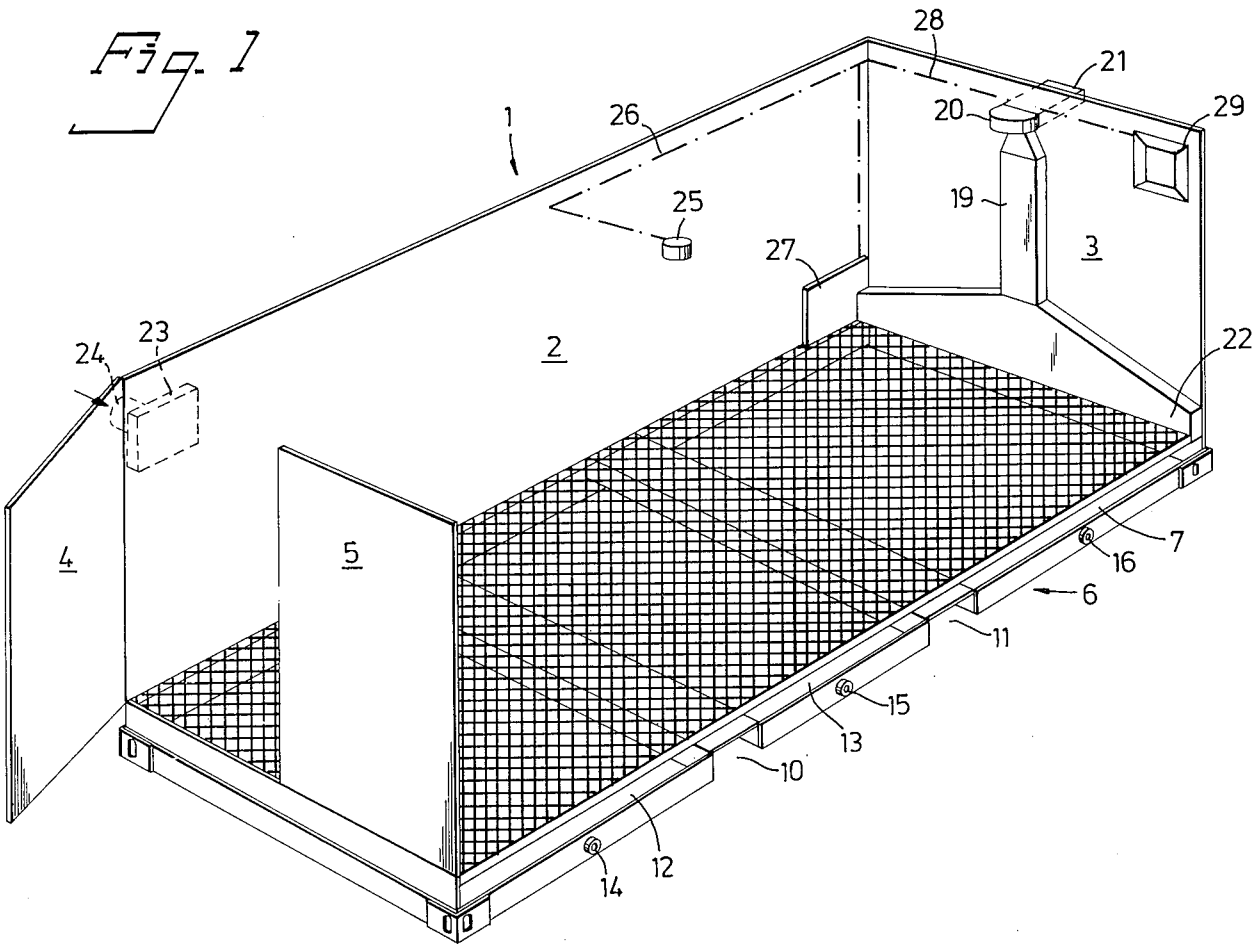
FIG. 1 shows a perspective view of an embodiment of the invention, the roof of the container and one long side of it having been removed to show its interior.

The goods container 1 has a longitudinally extended side wall 2, an end wall 3 and an end wall formed by two doors or hatches 4 and 5, connected to the wall 2 and the (removed) forward wall by means of hinges (not shown). The container is further provided with a roof, although this has been removed in FIG. 1. Together with a supporting bottom, generally denoted by the numeral 6, the four side walls and the roof form a substantially leakproof unit when the doors 4,5 are closed.

Figure 2:
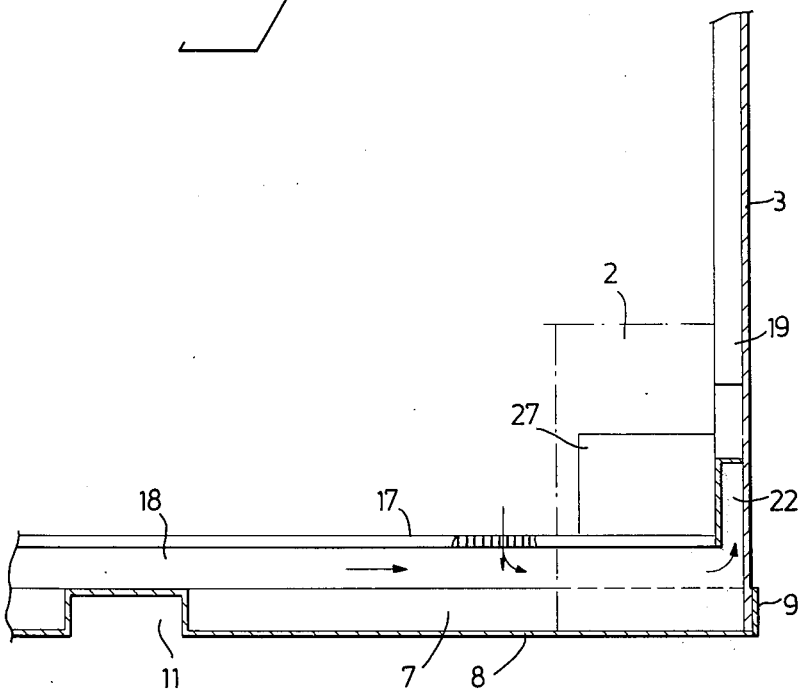
FIG. 2 shows a section through the right end of the bottom and the joining end wall of the container in FIG. 1.

According to the invention, the bottom consists of a leakproof tray 7 with a bottom 8 (FIG. 2) having upstanding side flanges 9 all the way round. In the embodiment shown, the bottom 8 has two tunnels 10,11 for the tynes of a fork truck. As is best apparent from FIG. 2, the side walls, e.g. side wall 3, have their lower edge portions lying inside the side flanges 9 and are leak-tightly joined to these in any suitable way at all, e.g. by means of bolts. The bottom can consist of sheet steel, for example, which has been folded to form the tyne tunnels 10,11 transversely extending along the whole width of the container 1. The side flanges 9 can similarly consist of flat steel plates welded to the formed sheets to form the liquid-tight tray. Other material can also be used, e.g. plywood, glass fibre reinforced plastic or the like. Since the tunnels project into the tray, the latter is divided into separate receptacles, e.g. receptacles 12 and 13. Each receptacle has a draining means in the shape of a tap, for example, or a hose connection 14,15,16 provided with a valve, enabling liquid collected in the receptacles to be tapped off or sucked off. An inner loadbearing floor 17, perforated or slit to allow the passage of liquid and gas to the tray 7, is placed at a distance from the upper portions of the tunnels and covers the whole of the free opening of the tray. Since the inner flat floor 17 is at a distance from the tunnels 11,12 there is formed a ventilation canal 18 having the same length and width as the floor 17 and the tray 7. This ventilation canal 18 is connected to an extraction duct 19 at one end of the container, the duct 19 being connected in turn to a suction fan 20. The suction fan 20 is mounted in the roof (not shown) of the container with its outlet connected to an outlet pipe 21 projecting out from the end wall 3 and is leak-tightly connected thereto. The outlet pipe 21 is arranged for connection to a ventilation system in the vessel. The said suction fan 20 can possibly be included in the ventilation system of the vessel as well. In the embodiment shown, the extraction duct 19 has a suction hood 22 extending over the entire width of the canal 18. It is however possible to use the extraction duct with, for example, a number of induction openings along the width of the canal 18.

There is a draught regulator 23 for feeding fresh air to the substantially leakproof container 1. The draught regulator 23 is preferably placed diagonally opposite the suction head 22 of the duct, as shown in FIG. 1. Perferably electrically operated by means not shown, the draught regulator has a connection 24 on the outside of the wall 2. A fresh air hose from a fresh air pipe in the vessel can be coupled to this connection if necessary.

The container described above functions in the following manner. If a poisonous liquid, giving off injurous gases, begins to leak out from a container stored in the vessel, the liquid will run through the floor 17 into the tray 7 and collect in the underlying receptacle in the tray, e.g. the receptacle 13. Liquid that has leaked out will thus be able to be kept in a comparatively limited area for tapping off at a suitable opportunity. During transport on the vessel, the draught regulator 23 is open and air is sucked in by means of the fan 20. The air stream passes from the draught regulator 24 and down through the openings in the floor 17 to the canal 18 entraining vaporized liquid which departs via the duct 19 to the said ventilation plant in the vessel. There is no risk of corrosive liquids or poisonous gases seeping out into the surroundings, and the container can therefore be placed anywhere on the vessel, e.g. on a car-deck.

So that a possible fire in the container can be quickly extinguished, there is a smoke detector or a heat detector 25 arranged to detect smoke and/or unusually high heat and to give a signal via a line 26 to an electrical apparatus 27, which in turn, over a line 28, triggers a fire extinguishing apparatus 29, arranged to fill the interior of the container with a halogen gas or a foam extinguishing agent, for example.

The invention is not limited to the embodiment shown but can be varied within the scope of the patent claims.

What we claim is:

1. A shipping container for transporting dangerous goods, such as poisonous or explosive liquids stored in cans, comprising:

(a) a roof member, a bottom member and four side wall members joined together to form a gas tight enclosure, one of said members comprising access means, (b) said bottom member comprising a plurality of upwardly open, liquid-tight trays separated from each other by respective tray side walls, (c) a plurality of fork lift tyne tunnels spaced from each other and defined between adjacent tray side walls, (d) an apertured, load-bearing inner floor disposed above said trays and tunnels to define a continuous ventillation passage extending beneath the full area of said inner floor, (e) forced air exhaust means mounted in said container in communication with said ventillation passage, and (f) adjustable air intake means disposed in said container and spaced from said air exhaust means, whereby any spilled liquid flows through said apertured inner floor into the tray therebeneath, and said exhaust means draws air through said intake means via the interior of said container and said ventillation passage, to thereby purge any dangerous liquid vapors from said container.

2. A shipping container as claimed in claim 1, wherein the air exhaust means comprises a suction duct connected to the ventillation passage at one end of the inner floor, and the air intake means is disposed above the opposite end of the inner floor.

3. A shipping container as claimed in claim 2, wherein the suction duct has an elongated suction opening extending substantially across the whole width of the inner floor.

4. A shipping container as claimed in claim 3, wherein the air exhaust means includes a suction fan mounted in the container and connected to the suction duct, and an outlet duct connected to an outlet of the suction fan and adapted to be connected to an exterior ventilation system.

5. A shipping container as claimed in claim 3, wherein the air intake means comprises a draft regulator connected to an intake duct mounted on one side wall of the container.

6. A shipping container as claimed in claim 2, wherein the air exhaust means includes a suction fan mounted in the container and connected to the suction duct, and an outlet duct connected to an outlet of the suction fan and adapted to be connected to an exterior ventilation system.

7. A shipping container as claimed in claim 1, further comprising a liquid tap mounted in each tray.

8. A shipping container as claimed in claim 7, wherein the air intake means comprises a draft regulator connected to an intake duct mounted on one side wall of the container.

* * * * *